US008814997B2

(12) United States Patent
Imori et al.

(10) Patent No.: US 8,814,997 B2
(45) Date of Patent: Aug. 26, 2014

(54) ELECTROLESS PLATING PRETREATMENT AGENT, ELECTROLESS PLATING METHOD USING SAME, AND ELECTROLESS PLATED OBJECT

(75) Inventors: Toru Imori, Kitaibaraki (JP); Jun Suzuki, Kitaibaraki (JP); Ryu Murakami, Hitachi (JP); Akihiro Aiba, Hitachi (JP); Junichi Ito, Kitaibaraki (JP)

(73) Assignee: JX Nippon Mining & Metals Corporation, Chiyoda-ku, Tokyo (JP)

( * ) Notice: Subject to any disclaimer, the term of this patent is extended or adjusted under 35 U.S.C. 154(b) by 242 days.

(21) Appl. No.: 13/501,139

(22) PCT Filed: Mar. 14, 2011

(86) PCT No.: PCT/JP2011/055951

§ 371 (c)(1),
(2), (4) Date: Apr. 10, 2012

(87) PCT Pub. No.: WO2011/118439

PCT Pub. Date: Sep. 29, 2011

(65) Prior Publication Data

US 2012/0192758 A1 Aug. 2, 2012

(30) Foreign Application Priority Data

Mar. 23, 2010 (JP) ..... 2010-066705

(51) Int. Cl.

| | |
|---|---|
| ***C23C 18/30*** | (2006.01) |
| ***B05D 1/18*** | (2006.01) |
| ***B05D 3/10*** | (2006.01) |
| ***C23C 18/18*** | (2006.01) |
| ***C23C 18/16*** | (2006.01) |
| ***C23C 18/20*** | (2006.01) |

(52) U.S. Cl.

CPC ..... *C23C 18/1608* (2013.01); *C23C 18/1882* (2013.01); *C23C 18/1879* (2013.01); *C23C 18/1635* (2013.01); *C23C 18/30* (2013.01); *C23C 18/2066* (2013.01)

USPC ..... 106/1.11; 106/1.28; 427/304

(58) Field of Classification Search

USPC ..... 106/1.11, 1.21, 1.28; 427/304

See application file for complete search history.

(56) References Cited

U.S. PATENT DOCUMENTS

| | | | | |
|---|---|---|---|---|
| 4,248,632 | A * | 2/1981 | Ehrich et al. | 106/1.11 |
| 4,986,848 | A * | 1/1991 | Yamamoto et al. | 106/1.11 |
| 5,292,361 | A * | 3/1994 | Otsuka et al. | 106/1.28 |
| 5,503,877 | A * | 4/1996 | Stamp et al. | 427/98.1 |
| 5,518,760 | A * | 5/1996 | Ferrier et al. | 422/304 |
| 7,045,461 | B2 * | 5/2006 | Imori et al. | 427/304 |
| 7,179,741 | B2 * | 2/2007 | Imori et al. | 438/675 |
| 7,713,340 | B2 * | 5/2010 | Kawamura et al. | 106/1.11 |
| 7,867,564 | B2 * | 1/2011 | Imori et al. | 427/304 |
| 8,043,705 | B2 * | 10/2011 | Kawamura et al. | 428/413 |
| 8,182,873 | B2 * | 5/2012 | Imori et al. | 427/304 |
| 8,591,637 | B2 * | 11/2013 | Rzeznik et al. | 106/1.11 |
| 2007/0071904 | A1 * | 3/2007 | Yabe et al. | 427/437 |
| 2007/0269680 | A1 * | 11/2007 | Kawamura et al. | 428/674 |
| 2010/0003474 | A1 * | 1/2010 | Kotsubo et al. | 428/201 |

FOREIGN PATENT DOCUMENTS

| | | | |
|---|---|---|---|
| EP | 0328263 | A2 * | 8/1998 |
| JP | 59-116363 | | 7/1984 |
| JP | 05-039580 | | 2/1993 |
| JP | 2008-041823 | | 2/2008 |
| WO | WO 2004-024984 | | 3/2004 |
| WO | WO 2005-073431 | | 8/2005 |
| WO | WO 2006/095589 | A1 * | 9/2006 |
| WO | WO 2008/016142 | A1 * | 2/2008 |

OTHER PUBLICATIONS

International Search Report of PCT/JP2011/055951 (2 pages), Jun. 2011.

* cited by examiner

*Primary Examiner* — Helene Klemanski

(74) *Attorney, Agent, or Firm* — Flynn, Thiel, Boutell & Tanis, P.C.

(57) ABSTRACT

An electroless plating pretreatment agent that can retain stably Pd(II) over a long period of time in an organic solvent, an electroless plating method using the same that is capable of forming an electroless plated film having excellent adhesion, and an electroless plated object. The electroless plating pretreatment agent contains an organic palladium compound and a coordination compound having a functional group with a metal-capturing capability dissolved in an organic solvent, the coordination compound being selected from the group consisting of the imidazole analogs, polyethyleneamines, ethyleneimines and polyethyleneimines.

10 Claims, No Drawings

ELECTROLESS PLATING PRETREATMENT AGENT, ELECTROLESS PLATING METHOD USING SAME, AND ELECTROLESS PLATED OBJECT

TECHNICAL FIELD

The present invention relates to an electroless plating pretreatment agent for providing a catalyst for electroless plating, and to an electroless plating method and electroless plated object using the same.

BACKGROUND ART

Known electroless plating pretreatment agents include plating pretreatment agents for catalyst adhesion, which adhere Pd or another precious metal to the surface of an object to be plated in order to confer electroless plating activity. Adhesion of the catalytic precious metal to the surface to be plated can be accomplished by a method such as coating with a solution of the pretreatment agent, dipping the object in a solution of the pretreatment agent, or drawing on the surface to be plated with an (inkjet) ink. The pretreatment agent must be one that can be used as a stable solution in order to achieve smooth adhesion to the object to be plated and uniformity of subsequent electroless plating.

Conventionally, colloidal solutions of tin and palladium and aqueous solutions of palladium chloride and other palladium compounds have been used as electroless plating catalysts. However, with aqueous solutions of inorganic palladium compounds for example one problem is that a sufficient quantity of Pd may not be retained because wettability is poor with respect to resin substrates that do not have affinity to aqueous solutions, or because the adhered Pd is removed by subsequent water washing, so organic solvent solutions are preferred as pretreatment agents for non-hydrophilic resin substrates. However, when pretreatment agents are provided as organic solvent solutions, there is a problem that the solubility is poor when inorganic palladium compounds are dissolved in the organic solvents used to dissolve resins and other organic compounds, so the palladium precipitates and a uniform solution cannot be obtained. Palladium acetate with its lower fatty acid is soluble in methanol at some concentrations, but the problem is that the palladium soon settles.

As an electroless plating pretreatment agent that is soluble and stable in inorganic solvents, Patent Document 1 discloses a pretreatment agent for electroless plating using a metal soap. It also discloses adding a silane coupling agent having a metal-capturing capability, but in both cases the pretreatment solution may turn black by gradual reduction of yellow Pd(II) into Pd(0), and a stable bivalent state of palladium cannot be maintained. Pd(II) can be stabilized by adding the aforementioned silane coupling agent, but if enough of the silane coupling agent is added to stabilize the Pd(II), the silane coupling agent covers the Pd because it has large molecules and a strong ability to coordinate to the Pd, making it difficult to reduce Pd(II) into Pd(0) having a capability of activating electroless plating after pretreatment of the object to be plated, and detracting from the subsequent plating properties in some cases.

Pd(II) cannot be thoroughly stabilized by such conventional methods, and while catalytic activity increases as Pd(II) is gradually reduced into Pd(0), the catalytic activity changes over time, and sediments may occur during long-term storage. If the Pd(II) is stabilized, on the other hand, it may then be difficult to reduce into Pd(0) as described above, and problems with the subsequent electroless plating properties may occur in some cases.

PRIOR ART DOCUMENTS

Patent Documents

Patent Document 1: WO 2005/073431

SUMMARY OF THE INVENTION

Problems that the Invention is to Solve

It is an object of the present invention to provide an electroless plating pretreatment agent that can retain stably Pd(II) over a long period of time in an organic solvent, an electroless plating method using the same that is capable of forming an electroless plated film having excellent adhesion, and an electroless plated object.

Means for Solving the Problems

The inventors arrived at the present invention as a result of exhaustive research after discovering that an electroless plating pretreatment agent prepared by dissolving, in an organic solvent, an organic palladium compound and a coordination compound having a functional group with a metal-capturing capability selected from the group consisting of the imidazole analogs, polyethylenamines, ethylenimines and polyethylenimines is capable of retaining Pd stably as Pd(II) in the solvent, and that a highly adhesive electroless plated film can thereby be formed after pretreatment.

That is, the present invention is as follows.

(1) An electroless plating pretreatment agent comprising an organic palladium compound and a coordination compound having a functional group with a metal-capturing capability dissolved in an organic solvent, in which the coordination compound is selected from the group consisting of the imidazole analogs, polyethyleneamines, ethyleneimines and polyethyleneimines and the coordination compound is added in an amount of 0.01 mole to 5 moles per 1 mole of the organic palladium compound.

(2) The electroless plating pretreatment agent according to (1) above, wherein the imidazole analog is a compound represented by General Formula (1) below:

Chemical Formula 1

Chemical Formula 1

(1)

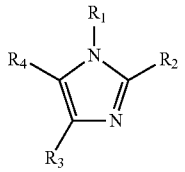

(where $R_1$, $R_2$, $R_3$ and $R_4$ each represent hydrogen, a lower alkyl or a phenyl group).

(3) The electroless plating pretreatment agent according to (2) above, wherein the compound represented by General Formula (1) above is a compound selected from imidazole, 1-methylimidazole, 2-methylimidazole, 2-phenylimidazole, 1,2-dimethylimidazole and 2,4-dimethylimidazole.

(4) The electroless plating pretreatment agent according to any one of (1) to (3) above, wherein the organic palladium compound is a palladium compound selected from the group consisting of palladium naphthenate, acetylacetone palladium, and a fatty acid palladium with 5 to 25 carbon atoms.

(5) The electroless plating pretreatment agent according to (4) above, wherein the fatty acid palladium with 5 to 25 carbon atoms is palladium neodecanoate, palladium octylate, palladium heptanoate or palladium pentadecanoate.

(6) The electroless plating pretreatment agent according to any one of (1) to (5) above, further comprising a dissolved silane coupling agent having a metal-capturing capability.

(7) An ink composition containing the electroless plating pretreatment agent according to any one of (1) to (6) above.

(8) An electroless plating method, comprising pretreating an object to be plated with the electroless plating pretreatment agent or ink composition described in any one of (1) to (7) above, and then electroless plating.

(9) The electroless plating method according to (8) above, wherein the pretreating the object to be plated is drawing by an inkjet method using the ink composition containing the electroless plating pretreatment agent.

(10) A plated object obtained by the electroless plating method according to (8) or (9) above.

Advantageous Effects of the Invention

The electroless pretreatment agent of the present invention is capable of retaining Pd stably in the form of Pd(II), without producing any sediment during long-term storage. Activation treatment is also easy after an object to be plated is treated with this pretreatment agent, and because a film formed by this treatment contains metal-coordinating functional groups, the plated film that is formed afterwards has an enhanced adhesion strength.

Moreover, an electroless plated film with excellent adhesiveness can be formed by treatment with the electroless plating pretreatment agent of the present invention.

MODE FOR CARRYING OUT THE INVENTION

The electroless plating pretreatment agent of the present invention comprises an organic palladium compound and a coordination compound having a functional group with a metal-capturing capability dissolved in an organic solvent wherein the coordination compound is selected from the group consisting of the imidazole analogs, polyethyleneamines, ethyleneimines and polyethyleneimines.

To obtain a stable Pd(II) solution in the present invention, the coordination compound having a functional group with a metal-capturing capability is reacted with the organic palladium compound to thereby coordinate the coordination compound to the Pd(II) and produce a stabilized compound. This reaction can be achieved simply by mixing at room temperature, but heating at or below the boiling point of the organic solvent used is also possible when the reaction is difficult.

The organic palladium compound used in the present invention is preferably palladium naphthenate, acetylacetone palladium or a fatty acid palladium.

The fatty acid palladium has preferably 5 carbon atoms to 25 carbon atoms, or more preferably 7 carbon atoms to 16 carbon atoms. If the number of carbon atoms in the fatty acid is 4 or less, the compound is difficult to dissolve in the organic solvent, and becomes unstable. If the number of carbon atoms is 26 or more, on the other hand, the dissoluble amount in organic solvents is limited, and the palladium content in the fatty acid palladium is also smaller, which is impractical because more fatty acid palladium must be added to the treatment agent.

Examples of the fatty acid include heptanoic acid, octanoic acid, octylic acid, decanoic acid, neodecanoic acid, dodecanoic acid, pentadecanoic acid, octadecanoic acid and other saturated fatty acids, oleic acid, linoleic acid and other unsaturated fatty acids, and hydroxytetradecanoic acid, carboxydecanoic acid and other oxygen-containing fatty acids and mixtures of these.

Particularly desirable examples of the fatty acid include octylic acid, neodecanoic acid, pentadecanoic acid, heptanoic acid and the like.

Another desirable example of the organic palladium compound is the palladium naphthenate shown below.

Chemical Formula 2

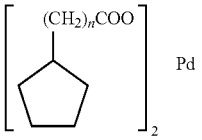

Mixture of n=9 to 13

Structural formula of palladium naphthenate

The aforementioned palladium naphthenate and fatty acid palladium compounds can be obtained by ordinary methods of manufacturing metal soaps, such as a direct method or a double decomposition method using the aforementioned naphthenic acid or fatty acid together with a palladium compound.

The organic palladium compound used in the present invention is soluble in an organic solvent. It is also capable of stably retaining Pd as Pd(II) by coordinating Pd(II) to a group of coordination compounds having a functional group with a specific metal-capturing capability.

Examples of such organic solvents include butanol, hexanol, 2-ethylhexanol, octyl alcohol and other alcohols, xylene and other aromatic hydrocarbons, hexane, decane and other aliphatic hydrocarbons, and chloroform, dioxane and the like.

The organic palladium compound can be used at a concentration of 1 mg/L to 30,000 mg/L or preferably 50 mg/L to 10,000 mg/L in a solution of the treatment agent.

In addition to the aforementioned organic palladium compound, a coordination compound having a functional group with a metal-capturing capability selected from the group consisting of the imidazole analogs, polyethyleneamines, ethyleneimines and polyethyleneimines is dissolved in the electroless plating pretreatment agent of the present invention.

A compound represented by the following General Formula (1) is preferred as the imidazole analog.

Chemical Formula 3

(1)

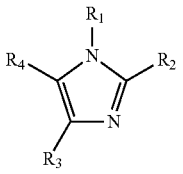

In General Formula (1), $R_1$, $R_2$, $R_3$ and $R_4$ each represent hydrogen, a lower alkyl group or a phenyl group.

An alkyl group having 1 to 4 carbon atoms is preferred as the lower alkyl group. Examples of compounds represented by General Formula (1) above include imidazole, 1-methylimidazole, 2-methylimidazole, 2-phenylimidazole, 1,2-dimethylimidazole and 2,4-dimethylimidazole.

In the present invention, the aforementioned polyethyleneamines are compounds represented by the General Formula $NH_2(CH_2CH_2NH)nH$, and examples include ethylene diamine, diethylene triamine, triethylene tetramine and the like. Polyethyleneamines with small molecules are preferred, and ethylene diamine is especially desirable.

A polymer with a number-average molecular weight of 100 to 100,000 is preferred as a polyethyleneimine. A polymer with a number-average molecular weight of 100 to 50,000 is more preferred because solubility in the solvent is lower when the number-average molecular weight is too large, and a polymer with a number-average molecular weight of 100 to 30,000 is especially desirable.

The content of the coordination compound having a functional group with a metal-capturing capability selected from the group consisting of the imidazole analogs, polyethyleneamines, ethyleneimines and polyethyleneimines in the electroless plating pretreatment agent of the present invention is preferably 0.01 mole to 5 moles or especially 0.05 mole to 4 moles of the coordination compound per 1 mole of the organic palladium compound from the standpoint of the stability of the pretreatment agent and the plating properties after pretreatment. When a polyethyleneamine or polyethyleneimine coordination compound is a polymer, the content thereof in the pretreatment agent is, from the standpoint of the stability of the pretreatment agent and the plating properties after pretreatment, preferably 0.04 g/L to 20 g/L, or more preferably 10 g/L or less, or especially 5 g/L or less. If the added amount of the coordination compound is too small, the stability of the liquid may be adversely affected by progress of valence conversion to Pd(0) during storage of the pretreatment agent, while if the added amount is too large, stability may be so great that adequate plating activity is not obtained during electroless plating, creating problems of plating failure.

The electroless plating pretreatment agent of the present invention can contain Pd stably as Pd(II), with no sedimentation during long-term storage. For example, the electroless plating pretreatment agent of the present invention can retain the Pd(II) without turning black even after being heated for 1 week at 60° C.

In the electroless plating pretreatment agent of the present invention, at least 50% of the total Pd is preferably Pd(II). More preferably at least 70%, or most preferably 100% of the palladium is retained in the form of Pd(II), or in other words all of the Pd in the treatment agent is contained as Pd(II). If the Pd(II) concentration is less than 50%, stable plating activity cannot be achieved because of changes over time, such as blackening and decomposition of the pretreatment agent.

The Pd(II) concentration of the total Pd in the electroless plating pretreatment agent is assumed to be the same as the Pd(II) concentration of the total Pd in a film obtained by treatment with the pretreatment agent. The fact that the peak position (peak shift) of the element in X-ray photoelectron spectrometry (XPS) differs according to its chemical state can be used for measuring the Pd(II) concentration of the total Pd in a film obtained by treatment with the pretreatment agent. For example, using the fact that Pd(II) and Pd(0) have different peak positions, the Pd(II) concentration of the total Pd in the film can be measured with a Shimadzu ESCA-3200. This can then be given as the Pd(II) concentration of the total Pd in the electroless plating pretreatment agent.

A suitable amount of a silane coupling agent having a functional group with a metal-capturing capability in the molecule can also be added as necessary to the electroless plating pretreatment agent of the present invention. Because the electroless plating pretreatment agent of the present invention uses an organic solvent, a silane coupling agent can be added without causing hydrolysis, unlike a case where a pretreatment agent is aqueous solution. Adding this silane coupling agent serves to fix the Pd more uniformly and securely via the silane coupling agent to the surface to be plated, thereby improving adhesiveness. The silane coupling agent is preferably added in the amount of 0.05 mole to 3 moles or more preferably 0.1 mole to 2 moles per 1 mole of Pd.

This silane coupling agent can be added to the pretreatment agent of the present invention containing the organic palladium compound, after which an object to be plated is treated with this pretreatment agent, but a solution containing the silane coupling agent can also be prepared separately, and the object to be plated can be treated with this solution prior to being treated with the pretreatment agent containing the organic palladium.

This silane coupling agent is preferably obtained by a reaction of an azole compound or amine compound with an epoxysilane compound.

Examples of azole compounds include, but are not limited to, imidazole, oxazole, thiazole, selenazole, pyrazole, isoxazole, isothiazole, triazole, oxadiazole, thiadiazole, tetrazole, oxatriazole, thiatriazole, bendazol, indazole, benzimidazole, benzotriazole and the like. Imidazole is especially preferred.

Examples of amine compounds include propylamine and other saturated hydrocarbon amines, vinylamine and other unsaturated hydrocarbon amines, and phenylamine and other aromatic amines and the like.

In addition to a precious metal-capturing groups derived from the aforementioned azole or amine compounds, the silane coupling agent may also be a compound having —SiX1X2X3 groups, in which X1, X2 and X3 each represent an alkyl group, halogen, alkoxy group or the like, and are functional groups that can be fixed to an object to be plated. X1, X2 and X3 may be the same or different.

The aforementioned silane coupling agent can be obtained by reacting the aforementioned azole or amine compound with an epoxysilane compound.

An epoxysilane coupling agent represented by the following formula:

Chemical Formula 4

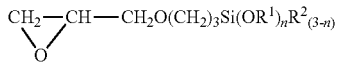

(in which $R^1$ and $R^2$ are each hydrogen or an alkyl group having 1 to 3 carbon atoms, and n is an integer from 0 to 3) is preferred as such an epoxysilane compound.

A reaction between the azole compound and the epoxy group-containing silane compound can be accomplished under the conditions described in Japanese Patent Application Publication No. 6-256358 for example.

For example, it can be accomplished by dripping in 0.1 mole to 10 moles of the epoxy-containing silane compound per 1 mole of the azole compound at 80° C. to 200° C., and reacting the two for 5 minutes to 2 hours. A solvent is not especially necessary, but an organic solvent such as chloroform, dioxane, methanol or ethanol may be used.

A reaction between imidazole and an epoxysilane compound is shown below as an especially desirable example.

Chemical Formula 5

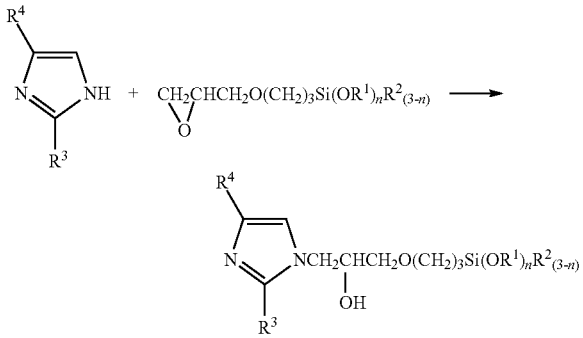

(wherein $R^1$ and $R^2$ are each hydrogen or an alkyl group with 1 to 3 carbon atoms, $R^3$ is hydrogen or an alkyl group having 1 to 20 carbon atoms, $R^4$ is a vinyl group or an alkyl group having 1 to 5 carbon atoms, and n is an integer from 0 to 3).

Other examples of silane coupling agents with a functional group having a metal-capturing capability for use in the present invention include γ-aminopropylmethoxysilane, γ-aminopropyltriethoxysilane, N-β(aminoethyl)γ-aminopropyltrimethoxysilane, N-β(aminoethyl)γ-aminopropyltriethoxysilane, γ-mercaptopropyltrimethoxysilane and the like.

The electroless plating pretreatment agent of the present invention can also be made into an ink composition containing the treatment agent, and drawn on an object to be plated with an inkjet system. In this case, any viscosity adjusters, surface active agents or other additives necessary for fulfilling the requirements of the ink can be added.

By drawing with an inkjet system using the ink composition of the present invention, it is possible to form a fine line pattern of 30 μm to 50 μm in width. Of course, even finer patterns can be achieved if the object to be plated is surface treated to control the wettability to the ink. Because the ink composition of the present invention has a low solids content unlike conventional paste inks, it can form fine patterns with good linearity, and can therefore yield a plated object with a fine pattern. It is also less expensive because of the small amount of metal component in the ink.

In the electroless plating method of the present invention, an object to be plated is first pretreated with the electroless plating pretreatment agent or ink composition of the present invention, after which the Pd(II) is activated by reducing it to Pd(0) having electroless plating activity. Electroless plating is then performed.

The nitrogen in the imidazole analog used in the present invention has relatively low coordination ability to Pd, making it relatively easy to reduce Pd(II) to Pd(0) after pretreatment of the object to be plated.

Of the amine compounds, acrylamine polymers and the like can stably retain the Pd in the pretreatment agent without producing sediment because they coordinate to Pd(II) and stabilize the Pd as Pd(II), but the Pd is then so stabilized that it is difficult to reduce into Pd(0) during activation. However, relatively small polyethyleneamines such as ethylene diamine, diethylene triamine or triethylene tetramine can stabilize (chelate) Pd with addition in relatively small amounts, making it relatively easy to reduce Pd(II) into Pd(0) so that plating activity is conferred after pretreatment of the object to be plated.

Although ethyleneimine and polyethyleneimine stabilize Pd(II) in the pretreatment agent, they have relatively low coordination ability to Pd(II), and because coordination to Pd(II) is weak the Pd(II) can be reduced to Pd(0) relatively easily with a reducing agent or by activation treatment.

The coordination compound having a functional group with a metal-capturing capability used in the present invention can coordinate to Pd(II) in the electroless plating pretreatment agent, retaining the Pd stably as Pd(II), while allowing the Pd(II) to be reduced relatively easily to Pd(0) during activation. As a result, the subsequent electroless plating properties are excellent, and an electroless plating film can be formed that is uniform and highly adhesive.

The object to be plated that is treated with the electroless plating pretreatment agent of the present invention is not limited by the properties thereof. For example, glass, ceramic and other inorganic materials; polyester, polyamide, polyimide, fluorine resin and other plastic materials, and films, sheets and fibers of these; insulators such as epoxy resin which may be reinforced with glass cloth as necessary and other insulating boards; and objects with low conductivity such as Si wafers and other semiconductors can be treated with the electroless plating pretreatment agent of the present invention. The method of the present invention can be applied favorably even if the object to be plated is a transparent glass plate or an object with a mirrored surface such as a Si wafer or other semiconductor substrate, or even if it is a powder. Examples of such powders include glass beads, molybdenum disulfide powder, magnesium oxide powder, graphite powder, SiC powder, zirconium oxide powder, alumina powder, silicon oxide powder, mica flakes, glass fiber, silicon nitride, or Teflon™ powder and the like.

Examples of treatment methods include immersion treatment, brush painting, inkjet systems, spin coating and the like.

If the base is a cloth or plate, the ordinary method is to coat the surface of the base with the pretreatment agent by dipping, brush painting or the like and then evaporate the solvent, but the treatment methods are not limited only to these methods. Any other methods that adhere the treatment agent uniformly to the surface can be used. In the case of a powder, there is a method in which the solvent is volatilized after immersion to forcibly adhere the palladium in the treatment agent to the surface of the base. In addition, since adhesion to the base surface in an immersed state is possible due to the uniform film-forming properties of the treatment agent, it also is possible to employ a method in which after the solvent has been filtered out after treatment, wet powder is dried. Depending on the adhesion state water washing may be sufficient, and the drying step can be omitted.

To volatilize the solvent used in surface treatment after the surface treatment, it is sufficient to dry the surface by heating to at or above the volatilization temperature of the solvent, and heating for 30 minutes to 60 minutes at 50° to 220° C. or preferably 180° C. to 220° C. is desirable.

On such a surface-treated surface to be plated, the Pd is in the form of Pd(II), which has a low electroless plating activity. Thus, Pd(II) is reduced to Pd(0), which has a high electroless plating activity.

Such activation methods include methods using reducing agents such as dimethylamino borane or sodium hypophosphite, and a method of simply heating to 100° C. or more. Heating may cause further oxidation from Pd(0), but PdO also has a plating activity.

The drying temperature for volatilizing the solvent is 100° C. or more, and drying and activation can be performed simultaneously.

In the electroless plating method of the present invention, ordinary methods of electroless plating can be applied to an object to be plated that has been pretreated as described above. Examples of electroless plating include copper, nickel, tin and silver plating for example.

Thus, with the present invention it is possible to obtain an electrolessly plated object having an electroless plated film of copper, nickel, tin, silver or the like that is uniform and highly adhesive. The resulting electroless plated film exhibits good performance in a peeling test using an adhesive tape, and in a 90-degree peel strength test measuring the force required to peel off the formed electroless plated film in a direction perpendicular to the surface of the plated object, for example an electroless copper plated film with a thickness of 0.3 μm to 25 μm exhibits a strong adhesion strength of 0.3 kgf/cm$^2$ to 1.2 kgf/cm$^2$.

EXAMPLES

The present invention is explained in detail below using examples.

Example 1

10.0 g (0.022 mole) of palladium neodecanoate and 5.3 g (0.055 mole) of 1,2-dimethylimidazole were added to 1 L of butanol, and dissolved by agitation and heating at 40° C. The resulting solution (electroless plating pretreatment agent) did not turn black even when heated for 1 week at 60° C., retaining the yellow color it had at preparation. After this heating, the electroless plating pretreatment agent was applied with a spin coater to a polyimide film, and when the Pd electron states of the resulting film were measured by XPS (measurement conditions: current value 30 mA, voltage 8 kV), 100% of the Pd(II) state was retained, or in other words all of the Pd was in the form of Pd(II). This polyimide was immersed for 10 minutes at 30° C. in a dimethylamine borane electroless plating activator (PM-R2, made by Nippon Mining & Metals Co., Ltd.), water washed, and immersed for 5 minutes at 30° C. in an electroless copper plating solution (NKM-554, made by Nikko Shoji Co., Ltd.) to perform electroless copper plating. The resulting electroless plated film was formed uniformly on the entire surface of the polyimide film. The adhesion strength of the plated film was confirmed to be good in a tape test. For the tape test, scotch tape was affixed to the plated film and pulled upward at an angle of 90° to the film surface, and the adhesion strength was evaluated in terms of whether or not the plated film was peeled off. In this and the following examples, "good" means that the plated film was not peeled off.

Example 2

Electroless copper plating was performed by the same operations as in Example 1 except that the pretreatment agent was applied by spin coating to a glass epoxy substrate in place of a polyimide film. Furthermore, copper electroplating was performed for 50 minutes at 2.5 A/dm$^2$ using a copper electroplating solution (copper sulfate 72 g/L, sulfuric acid 180 g/L, chlorine 60 ppm, brightening agent 1 mL/L) with a phosphorus-containing anode, forming a 25 μm-thick copper plated film. The adhesion strength of the plated film was measured by the 90-degree peel strength test. The peel strength test showed a strong adhesion strength of 1.2 kgf/cm$^2$.

Example 3

Electroless copper plating was performed by the same operations as in Example 1 except that 8.6 g (0.022 mole) of palladium octylate was added in place of 10.0 g of palladium neodecanoate, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Example 4

Electroless copper plating was performed by the same operations as in Example 1 except that 5.0 g (0.060 mole) of 1-methylimidazole was added instead of 5.3 g of 1,2-dimethylimidazole, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Example 5

Electroless copper plating was performed by the same operations as in Example 1 except that 9.5 g (0.022 mole) of palladium naphthenate was added instead of 10.0 g of palladium neodecanoate, 1 L of xylene was used as the solvent, and a glass substrate was used as the object to be plated, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the glass substrate, and the adhesion strength of the plated film was confirmed to be good in the tape test.

Example 6

Electroless copper plating was performed by the same operations as in Example 1 except that 6.6 g (0.022 mole) of acetylacetone palladium was added instead of 10.0 g of palladium neodecanoate and 1 L of hexanole was used as the solvent, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Example 7

Electroless copper plating was performed by the same operations as in Example 1 except that 7.2 g (0.080 mole) of 2-methylimidazole was used instead of 5.3 g of 1,2-dimethylimidazole, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Example 8

Electroless copper plating was performed by the same operations as in Example 1 except that 2.0 g (0.033 mole) of ethylenediamine was added instead of 5.3 g of 1,2-dimethylimidazole, 1 L of octanol was used as the solvent, and glass epoxy resin was used as the object to be plated, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the glass epoxy resin, and the adhesion strength of the plated film was confirmed to be good in the tape test.

Example 9

Electroless copper plating was performed by the same operations as in Example 1 except that an electroless plating pretreatment agent obtained by the same method as in Example 1 was coated by spin coating on a glass substrate, and heat treated for 5 minutes at 60° C. and for 1 hour at 200° C. in atmosphere, and the adhesiveness of the resulting electroless plated film was evaluated. As in the case of wet activation treatment, an electroless copper plated film with good adhesion strength was formed on the entire surface of the glass substrate.

Example 10

Electroless copper plating was performed by the same operations as in Example 1 except that 1.0 g of polyethyleneimine with a number-average molecular weight of 600 was added instead of 5.3 g of 1,2-dimethylimidazole, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Example 11

Electroless copper plating was performed by the same operations as in Example 1 except that 5.0 g (0.011 mole) of palladium neodecanoate, 5.3 g (0.055 mole) of 1,2-dimethylimidazole and 3.0 g (0.010 mole) of imidazole silane obtained from a reaction of imidazole and epoxysilane were added to 1 L of butanol, and the adhesiveness of the resulting electroless plated film was evaluated. As in Example 1, it was confirmed that the electroless plating pretreatment agent did not turn black even after being heated for 1 week at 60° C., and 100% of the Pd(II) state was retained. Moreover, the resulting electroless plated film was formed uniformly on the entire surface of the polyimide film, and the adhesion strength of the plated film was confirmed to be good in the tape test.

Comparative Example 1

An electroless plating pretreatment agent was prepared as in Example 1 except that no 1,2-dimethylimidazole was added. When the electroless plating pretreatment agent was left for a day and a night at room temperature, it produced a black sediment and decomposed.

Comparative Example 2

The same operations were performed as in Example 1 except that 30.0 g (0.136 mole) of 3-aminopropyl trimethoxysilane was added instead of 5.3 g of 1,2-dimethylimidazole. The resulting electroless plating pretreatment agent retained its yellow color even after being heated for 1 week at 60° C., and it was confirmed by XPS that conversion to Pd(0) did not progress. Electroless copper plating could not be achieved.

The invention claimed is:

1. An electroless plating pretreatment agent consisting of an organic palladium compound and a coordination compound having a functional group with a metal-capturing capability dissolved in an organic solvent, in which the coordination compound is selected from the group consisting of imidazole analogs, polyethyleneamines, ethyleneimines and polyethyleneimines and the coordination compound is added in an amount of 0.01 mole to 5 moles per 1 mole of the organic palladium compound, wherein the imidazole analogs is a compound represented by Formula (1) below:

(1)

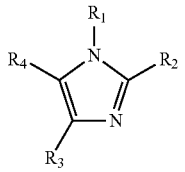

where $R_1$, $R_2$, $R_3$ and $R_4$ each represent hydrogen, a lower alkyl or a phenyl group.

2. The electroless plating pretreatment agent according to claim 1, wherein the compound represented by Formula (I) is selected from the group consisting of imidazole, 1-methylimidazole, 2-methylimidazole, 2-phenylimidazole, 1,2-dimethylimidazole and 2,4-dimethylimidazole.

3. The electroless plating pretreatment agent according to claim 1, wherein the organic palladium compound is selected from the group consisting of palladium naphthenate, acetylacetone palladium and a fatty acid palladium compound with 5 to 25 carbon atoms.

4. The electroless plating pretreatment agent according to claim 3, wherein the fatty acid palladium compound with 5 to 25 carbon atoms is palladium neodecanoate, palladium octylate, palladium heptanoate or palladium pentadecanoate.

5. An ink composition containing the electroless plating pretreatment agent according to claim 1.

6. An electroless plating method, comprising pretreating an object to be plated with the electroless plating pretreatment agent described in claim 1 and then electroless plating.

7. A plated object obtained by the electroless plating method according to claim 6.

8. An electroless plating method, comprising pretreating an object to be plated with the ink composition described in claim 5 and then electroless plating.

9. The electroless plating method according to claim 8, wherein pretreating the object to be plated comprises a step of forming a fine line pattern on the object by drawing with the ink composition containing the electroless plating pretreatment agent.

10. A plated object obtained by the electroless plating method according to claim 8.

* * * * *